United States Patent [19]

Asai et al.

[11] Patent Number: 4,667,496

[45] Date of Patent: May 26, 1987

[54] APPARATUS FOR CONTROLLING DYNAMIC CHARACTERISTICS OF OUTER LOAD

[75] Inventors: Akio Asai; Kazuki Watanabe; Ryoji Yoshinaka; Kazunari Kirii, all of Toyota, Japan

[73] Assignee: Toyota Jidosha Kabushiki Kaisha, Toyoto, Japan

[21] Appl. No.: 758,127

[22] Filed: Jul. 23, 1985

[30] Foreign Application Priority Data

May 18, 1983 [JP] Japan ..... 58-87343

[51] Int. Cl.[4] ..... B21B 37/08

[52] U.S. Cl. ..... 72/20; 72/21; 72/28

[58] Field of Search ..... 72/20, 21, 453.13, 353, 72/354; 267/119

[56] References Cited

U.S. PATENT DOCUMENTS

| | | | |
|---|---|---|---|
| 3,824,821 | 7/1974 | Bergmann et al. | 72/20 |
| 3,825,811 | 7/1974 | Smith et al. | 72/20 |
| 3,961,510 | 6/1976 | Kovacs | 72/20 |
| 4,224,816 | 9/1980 | Elhaus et al. | 72/21 |
| 4,308,735 | 1/1982 | Nishi | 72/21 |
| 4,408,471 | 10/1983 | Gossard et al. | 72/21 |

FOREIGN PATENT DOCUMENTS

| | | | |
|---|---|---|---|
| 0050319 | 4/1982 | European Pat. Off. | 72/20 |

*Primary Examiner*—Robert L. Spruill
*Assistant Examiner*—Donald R. Studebaker
*Attorney, Agent, or Firm*—Cushman, Darby & Cushman

[57] ABSTRACT

An apparatus for controlling dynamic characteristics of an outer load includes a crank angle detecting device which detects a crank angle and an outer load detecting device which detects the outer load, output signals of the two detecting devices are input to a controlled hydraulic pressure correcting device in which an ideal value of outer load corresponding to the crank angle has been preset, a deflection rate between the detected outer load and the ideal value of outer load is judged in accordance with the detected crank angle and, each time that the deflection exceeds a predetermined range, the output of a hydraulic source for setting a balanced pressure is controlled so as to adjust the balanced pressure.

3 Claims, 3 Drawing Figures

APPARATUS FOR CONTROLLING DYNAMIC CHARACTERISTICS OF OUTER LOAD

FIELD OF THE INVENTION

This invention relates to an apparatus for controlling the dynamic characteristics of the outer load in a mechanical double-action press machine.

BACKGROUND OF THE INVENTION

A mechanical double-action press machine is normally provided with a regulating mechanism which regulates the press load. This regulating mechanism, as shown in FIG. 1, comprises hydroblank holder 4, protector cylinder 8, pneumatic device 12 and hydraulic device 15.

The hydroblank holder 4 incorporates piston 1 and has an air chamber 2 and an oil chamber 3 defined by the piston 1. The protector cylinder 8 defines an oil chamber 7 at a connection part between a connection screw 5 and an outer slide 6. The pneumatic device 12 includes pneumatic source 9, pressure regulating valve 10 and accumulator 11 and supplies a predetermined pneumatic pressure to oil chamber 2 in hydroblank holder 4. The hydraulic device 15 includes hydraulic source 13 and check valve 14 and supplies hydraulic pressure to oil chamber 3, in hydroblank holder 4, and oil chamber 7, in protector cylinder 8.

When a pneumatic pressure supplied to air chamber 2 in hydroblank holder 4, i.e., the regulator pressure, is set to a high level in the mechanical double-action press machine equipped with such a regulating mechanism, the hydraulic pressure does not operate, the incremental load produced by the pressure application of the press machine is transmitted directly to a press die through outer slide 6 to carry out a mechanical zone forming operation. In this case, the outer load is determined primarily by the die height of outer slide 6.

On the other hand, if the regulator pressure supplied to air chamber 2 is adequately balanced against the hydraulic pressure, the above mentioned incremental load is absorbed by the operation of piston 1 of hydroblank holder 4. Therefore, the load is transmitted to the press die through hydraulic pressure to carry out a hydraulic zone forming operation. In this case, the outer load is determined by the die height of the slide and the regulator pressure.

The values of the die height of the slide or the regulator pressure are determined through the procedure of finding the optimal processing condition beforehand by a test pressing. The values determined in the above procedure are set in the press machine in an actual production line and the press machine presses in accordance with the conditions thus set.

However, there exists an unavoidable mechanical difference between the two press machines. The regulator pressure is set manually by an operator monitoring meters; hence, it is extremely difficult in practice to effect precisely uniform regulation. As a result, a significant number of defects such as surface distortion and cracking are produced by the shifting dynamic characteristics of the outer load varying from the ideal condition. Therefore, to solve this problem, the dies are adjusted by a fitting process before they are brought into the production line to compensate for the machine difference and manual operation error of the regulator pressure.

However, the above method for solving the problem is not appropriate because the process of carefully fitting and adjusting the dies is time consuming; hence, productivity declines.

Moreover, as pneumatic pressure in a plant fluctuates with the state of the operation in each section and is influenced by a pneumatic source, the forming defects can also be produced by deterioration of the predetermined balance between the regulator pneumatic pressure in air chamber 2 and hydraulic pressure in oil chamber 3. Adjusting the dies cannot solve the problems caused by such factors as these, which occur during pressing. Therefore, fitting and adjusting the dies is not appropriate from this standpoint either.

SUMMARY OF THE INVENTION

It is an object of the present invention to provide an apparatus for controlling the dynamic characteristics of the outer load which facilitates preventing forming defects without decreasing productivity, and which also facilitates preventing forming defects when some factors, which are conducive to defects, occur during the pressing process.

To this end, the present invention provides an apparatus, for controlling the dynamic characteristics of the outer load, which comprises:

a crank angle detecting means which detects a crank angle; and outer load detecting means which detects an outer load; a hydraulic source control means which controls a hydraulic source for setting a balanced pressure with an output signal representing the hydraulic pressure to be controlled which determines the output of the above hydraulic source; a controlled hydraulic pressure detecting means which detects said controlled hydraulic pressure by the input of an output signal of said hydraulic source control means; and a controlled hydraulic pressure correcting means in which an ideal value of the outer load corresponding to the above crank angle is preset, into which an output signal of the crank angle detecting means is applied, and an output signal of the outer load detecting means and an output signal of the controlled hydraulic pressure detecting means are applied, which, in accordance with the detecting, judges a deflection rate between the ideal value of the outer load corresponding to the detected crank angle represented by the output signal of the outer load detecting means and which corrects the controlled hydraulic pressure so as to make the detected outer load agree with the ideal value of the outer load in accordance with the ideal value of the outer load, the detected outer load and the detected controlled hydraulic pressure represented by the output signal of the controlled hydraulic pressure detecting means.

While a press machine is operating, the deflection rate between the detected outer load and the ideal value of the outer load is judged by referring to the detected crank angle. When the deflection exceeds a predetermined range, the output of the hydraulic source is controlled and the balance is adjusted so that the dynamic characteristics of the outer load are controlled to follow an ideal curve defined by the ideal values of the outer load.

Therefore, the forming defects can be prevented without using the process of fitting and adjusting the dies which decreases productivity and reduces efficiency, when starting the die or every time that the operation is started.

These forming defects can be prevented even if some factors which cause forming defects occur during the press process.

The crank angle detecting means can be constituted, for instance, by a rotary cam which rotates with a crank solidly and an encoder whose input shaft is linked to the rotary cam.

The outer load detecting means is constituted, for instance, by the means which detects the outer load by converting a hydraulic pressure in a protector cylinder into an outer load or by a means which uses a strain gauge.

DETAILED DESCRIPTION OF THE INVENTION

One embodiment of the present invention will be described hereinunder with reference to the accompanying drawings.

Figure 1:
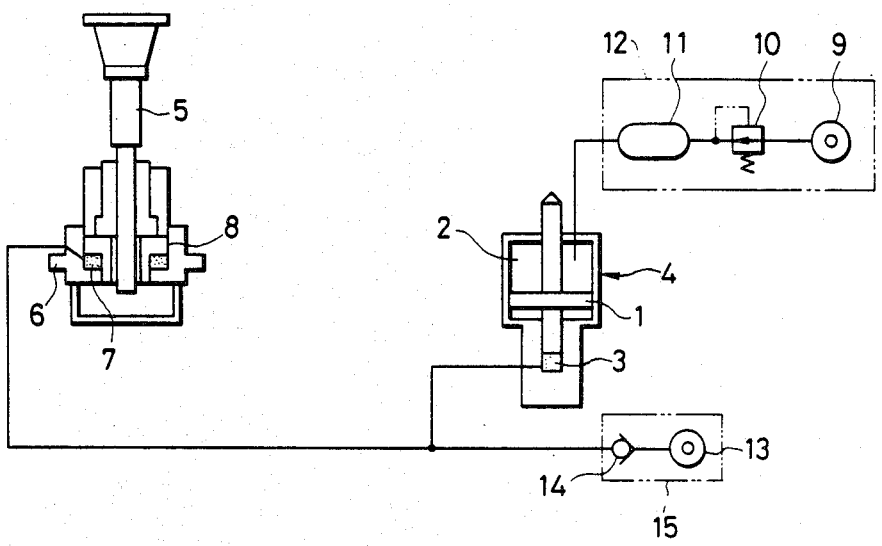
FIG. 1 is a sequence diagram of an outer load control mechanism of a press machine.
Figure 2:
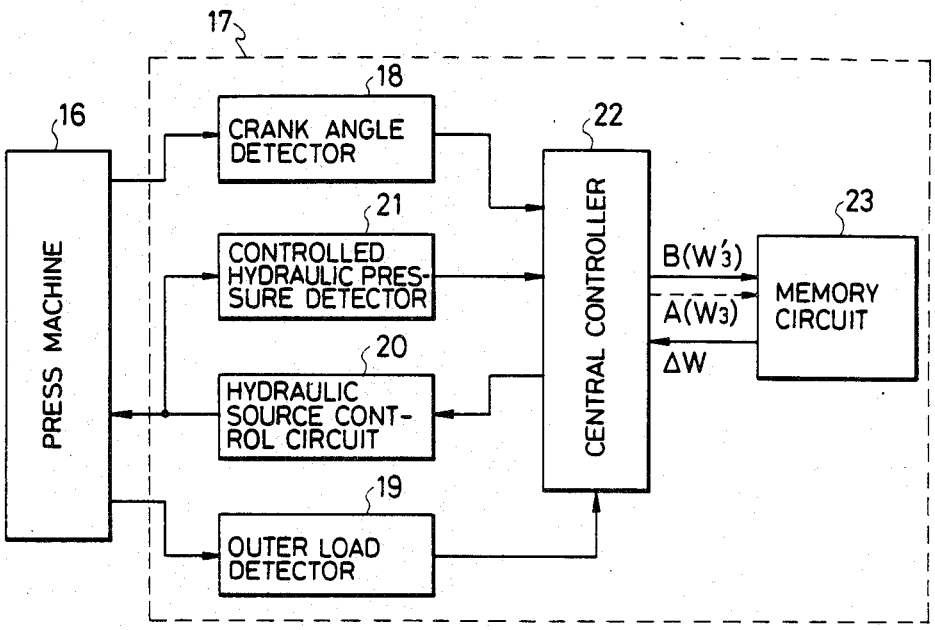
FIG. 2 is a block diagram showing an exemplary embodiment of the apparatus for controlling dynamic characteristic of the outer load of the present invention.

In FIG. 2, the reference numeral 16 is a press machine which includes an outer load control mechanism shown in FIG. 1 and the reference numeral 17 is the dynamic characteristics control apparatus of the present invention. This dynamic characteristics control apparatus 17 is constituted by crank angle detector 18 as a crank angle detecting means, outer load detector 19 as an outer load detecting means, hydraulic source control circuit 20 as a hydraulic source control means, controlled hydraulic pressure detector 21 as a controlled hydraulic pressure detecting means, central controller 22 as a controlled hydraulic pressure correcting means and memory circuit 23.

The crank angle detector 18 detects the rotation angle of a crank which ascends and descends a punch and is constituted by, for instance, a rotary cam rotating with the crank solidly and an encoder whose input shaft is linked to the rotary cam. The outer load detector 19 detects the outer load by converting the hydraulic pressure in oil chamber 7 into the outer load.

The hydraulic source control circuit 20 controls the output of hydraulic source 13 by its output signal and this output signal represents the hydraulic pressure to be controlled which determines the output of the hydraulic source. The output signal of hydraulic source control circuit 20 is input to controlled hydraulic pressure detector 21. The controlled hydraulic pressure detector 21 detects the controlled hydraulic pressure with the output signal received from hydraulic source control circuit 20.

The output signal of crank angle detector 18, the output signal of outer load detector 19 and the output signal of controlled hydraulic pressure detector 21 are input to central controller 22. The output signal of crank angle detector 18, the output signal of outer load detector 19 and the output signal of controlled hydraulic pressure detector 21 are stored in memory circuit 23 by central controller 22 and an ideal value of the outer load corresponding to each of the crank angles is preset in memory circuit 23. The memory circuit 23 calculates the deflection between a value above the ideal value of the outer load and the detected outer load represented by the output signal of the outer load detector 19, by referring to the detected crank angle, and judges the deflection rate between a value above the ideal value of the outer load and the detected outer load and, when the deflection rate thus obtained exceeds a predetermined range, calculates a hydraulic pressure to be corrected from the detected outer load, the detected controlled hydraulic pressure represented by the output signal of controlled hydraulic pressure detector 21 and the deflection.

The data including the information of the hydraulic pressure to be corrected are introduced into central controller 22 which corrects the controlled hydraulic pressure by controlling hydraulic source control circuit 20 in accordance with the data. As the output of hydraulic source 13 changes by the correction of the controlled hydraulic pressure, the hydraulic pressures in chambers 3 and 7 are changed. Observing the hydraulic pressure in oil chamber 3 in particular, the change of the hydraulic pressure means a change in the balanced pressure and the change in the balanced pressure means a change in the outer load.

Figure 3:
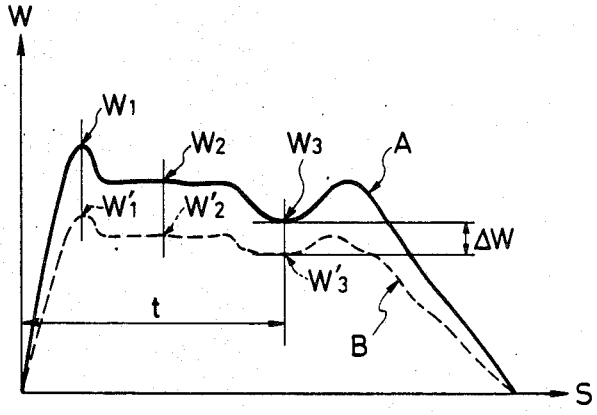
FIG. 3 is a characteristic diagram of the dynamic characteristics of the outer load for explanation of the operation of the apparatus shown in FIG. 2.

Referring to FIG. 3, the operation of an exemplary embodiment of the present invention constituted as mentioned above is described.

FIG. 3 shows the variation of the outer load W against a stroke S of a press tool from the time when the press tool touches a work piece till the time immediately before the tool starts ascending after the work piece has been shaped, i.e., the dynamic characteristics of the outer load. In FIG. 3, the symbol A shows the ideal characteristics, B shows the present characteristics, $W_1$ and $W_1$ show the maximum values and $W_3$ and $W'_3$ show the outer drop values.

During the operation of the press machine 16, respective output signals of crank angle detector 18, outer load detector 19 and controlled hydraulic pressure detector 21 are continuously input to memory circuit 23 through central controller 22 and the judgement of the deflection rate between the ideal value of the outer load and the detected outer load is continuously carried out by memory circuit 23. As a result of this judgement, if the deflection is within the predetermined range operation of the press machine 16 it is continued.

It is assumed that after (t) strokes have passed after load is applied to the work piece by a press tool, a deflection of W is produced and this deflection W exceeds the predetermined range.

Then the hydraulic pressure to be corrected is calculated by memory circuit 23 and the controlled hydraulic pressure of hydraulic source control circuit 20 is corrected, in accordance with the calculated hydraulic pressure to be corrected, by central controller 22.

After correction, the output of hydraulic source 13 comes out in accordance with the corrected controlled hydraulic pressure until the deflection exceeds the predetermined range again. Therefore, the dynamic characteristics of the outer load are controlled to follow the dynamic characteristics of curve A as close as possible.

What is claimed is:

1. An apparatus for controlling dynamic characteristics of outer load of a press tool comprising:

a crank angle detecting means which detects a crank angle of a crank;

an outer load detecting means which detects an outer load;

a hydraulic source control means which controls a hydraulic source for setting balanced pressure by generating an output signal representing a hydraulic pressure to be controlled, said generated output signal determining the output of said hydraulic source;

a controlled hydraulic pressure detecting means which detects said controlled hydraulic pressure by receiving said generated output signal from said hydraulic source control means; and a controlled hydraulic pressure correcting means having a preset ideal value of outer load corresponding to said crank angle said correcting means receiving an output signal from said crank angle detecting means, an output signal from said outer load detecting means and an output signal from said controlled hydraulic pressure detecting means, for continously judging a deflection rate between said preset ideal value of outer load, corresponding to the detected crank angle represented by said output of said crank angle detecting means, and the detected outer load, represented by said output of said outer load detecting means and for correcting said controlled hydraulic pressure so as to make said detected outer load agree with said preset ideal value of outer load, said detected outer load and the output signal of said controlled hydraulic pressure detecting means corresponding to the result of said judgement.

2. An apparatus as defined in claim 1, wherein said crank angle detecting means includes a rotary cam rotating solidly with the crank and an encoder having an input shaft linked to said rotary cam.

3. An apparatus as defined in claim 1, wherein said outer load detecting means detects said outer load by converting a hydraulic pressure in the protector cylinder into the outer load.

* * * * *